US008899997B2

(12) United States Patent
Zhang et al.

(10) Patent No.: US 8,899,997 B2
(45) Date of Patent: Dec. 2, 2014

(54) ELECTRICAL CONNECTOR WITH SOLDER BALL POSITIONED IN AN INSULATIVE HOUSING ACCURATELY

(75) Inventors: Jie-Feng Zhang, Shenzhen (CN); Yang Zhou, Shenzhen (CN); Fu-Jin Peng, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 166 days.

(21) Appl. No.: 13/589,190

(22) Filed: Aug. 20, 2012

(65) Prior Publication Data

US 2013/0045639 A1 Feb. 21, 2013

(30) Foreign Application Priority Data

Aug. 19, 2011 (CN) ..... 201120304208

(51) Int. Cl.
*H01R 12/00* (2006.01)
*H01R 12/57* (2011.01)

(52) U.S. Cl.
CPC ..... *H01R 12/57* (2013.01)
USPC ..... 439/83

(58) Field of Classification Search
USPC ..... 439/83, 342, 857, 856
See application file for complete search history.

(56) References Cited

U.S. PATENT DOCUMENTS

| | | | | |
|---|---|---|---|---|
| 6,247,954 | B1 * | 6/2001 | Ju | 439/342 |
| 6,572,397 | B2 * | 6/2003 | Ju | 439/342 |
| 6,699,055 | B2 * | 3/2004 | Peng et al. | 439/342 |
| 6,857,184 | B2 * | 2/2005 | Ju | 29/876 |
| 7,125,275 | B1 * | 10/2006 | Ju et al. | 439/342 |
| 8,052,434 | B2 * | 11/2011 | Yeh et al. | 439/83 |

* cited by examiner

*Primary Examiner* — Xuong Chung Trans
(74) *Attorney, Agent, or Firm* — Wei Te Chung; Ming Chieh Chang

(57) ABSTRACT

An electrical connector includes an insulative housing having a top surface, a bottom surface opposite to the top surface and a number of receiving holes penetrated the top surface and the bottom surface, a number of terminals receiving in the receiving holes and a number of solder balls assembled to the receiving holes from a bottom surface thereof and contacting with the corresponding terminals. The receiving hole includes an inner wall and a core, the inner wall has a pair of ribs extending toward to the core and the movement of the solder ball in a vertical direction is limited by the pair of ribs in a vertical direction and the solder ball is positioned by the terminal.

19 Claims, 6 Drawing Sheets

ELECTRICAL CONNECTOR WITH SOLDER BALL POSITIONED IN AN INSULATIVE HOUSING ACCURATELY

BACKGROUND OF THE INVENTION

1. Field of the Invention

The present invention relates to an electrical connector, and more particularly to an electrical connector mounted to a printed circuit board for receiving an Integrated Circuit package.

2. Description of the Prior Art

A conventional socket assembly comprises an insulative housing having a plurality of terminals received therein and a plurality of solder balls accommodated in the insulative housing. The terminals and solder balls received in a receiving space of the insulative housing. The solder ball is fixed in the insulative housing by the terminal and three sidewalls of the receiving space.

The sidewall has a large flat surface and the flat surface has a weak deformation to adjust to the different size of the solder balls and it is strict with the size of the receiving space and the solder balls. If the size of the solder ball is larger, the solder ball can not be fixed in the insulative housing and if the size of the receiving space is larger, the solder ball may fall into the insulative housing, and it can not be soldered to the printed circuit board.

Therefore, it is needed an improved electrical socket to overcome the problems mentioned above.

SUMMARY OF THE INVENTION

Accordingly, an object of the present invention is to provide an electrical connector capable of supporting the solder ball in vertical and positioning the solder ball in the insulative housing accurately.

In order to achieve the object set forth, an electrical connector comprises an insulative housing having a top surface, a bottom surface opposite to the top surface and a plurality of receiving holes penetrated the top surface and the bottom surface, a plurality of terminals received in the receiving holes and a plurality of solder balls assembled to the receiving holes from a bottom surface thereof and contacting with the corresponding terminals. The receiving hole comprises an inner wall and a core, the inner wall has a pair of ribs extending forward to the core and the movement of the solder ball in a vertical direction is limited by the pair of ribs in vertical and the solder ball is positioned by the terminal.

DESCRIPTION OF PREFERRED EMBODIMENT

Reference will now be made to the drawings to describe the present invention in detail.

Figure 1:
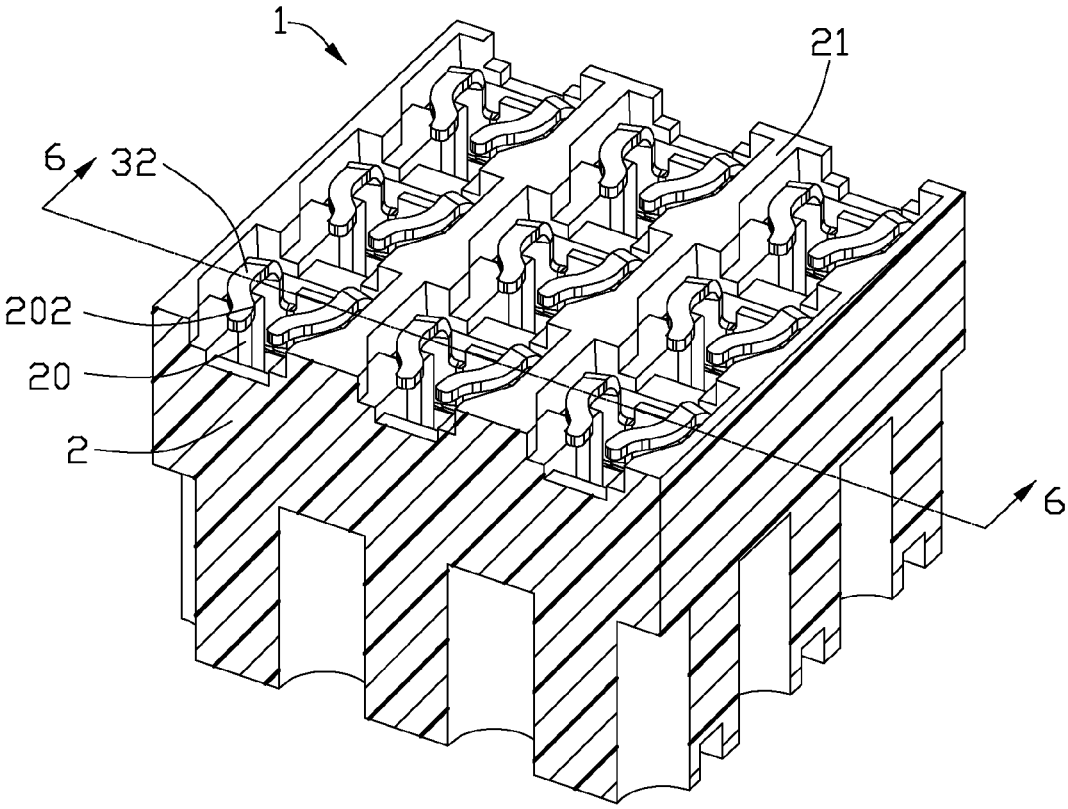
FIG. 1 is a perspective view of an electrical connector in accordance with a preferred embodiment of the present invention.
Figure 2:
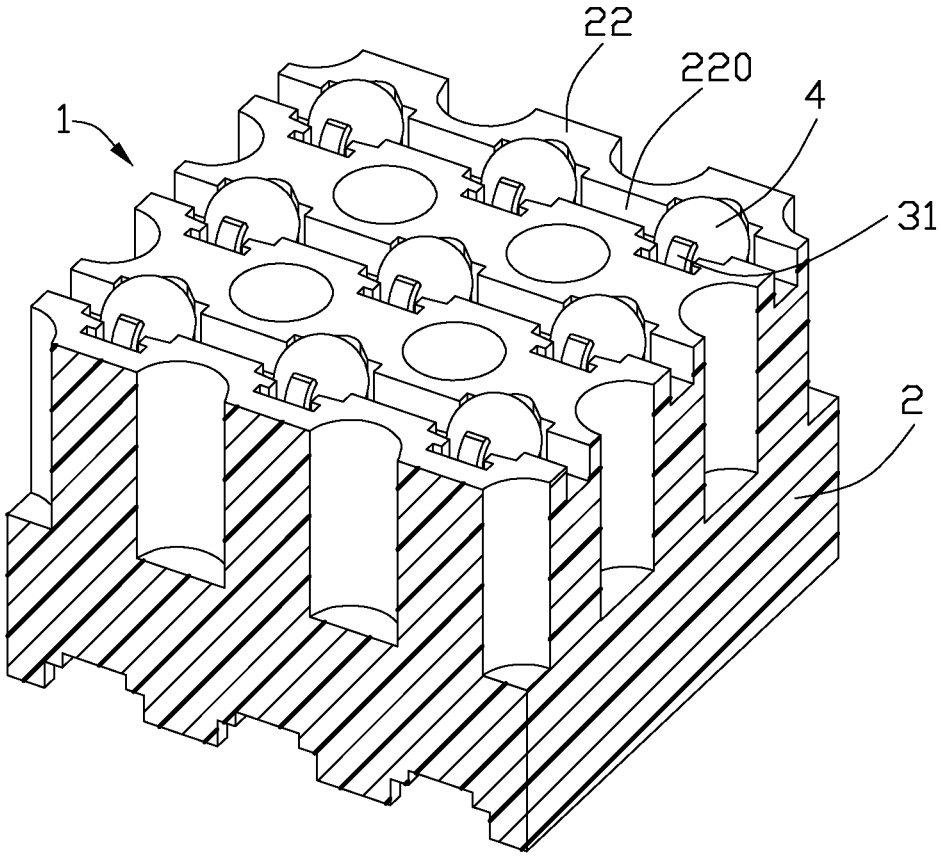
FIG. 2 is another perspective view of the electrical connector as shown in FIG. 1.
Figure 3:
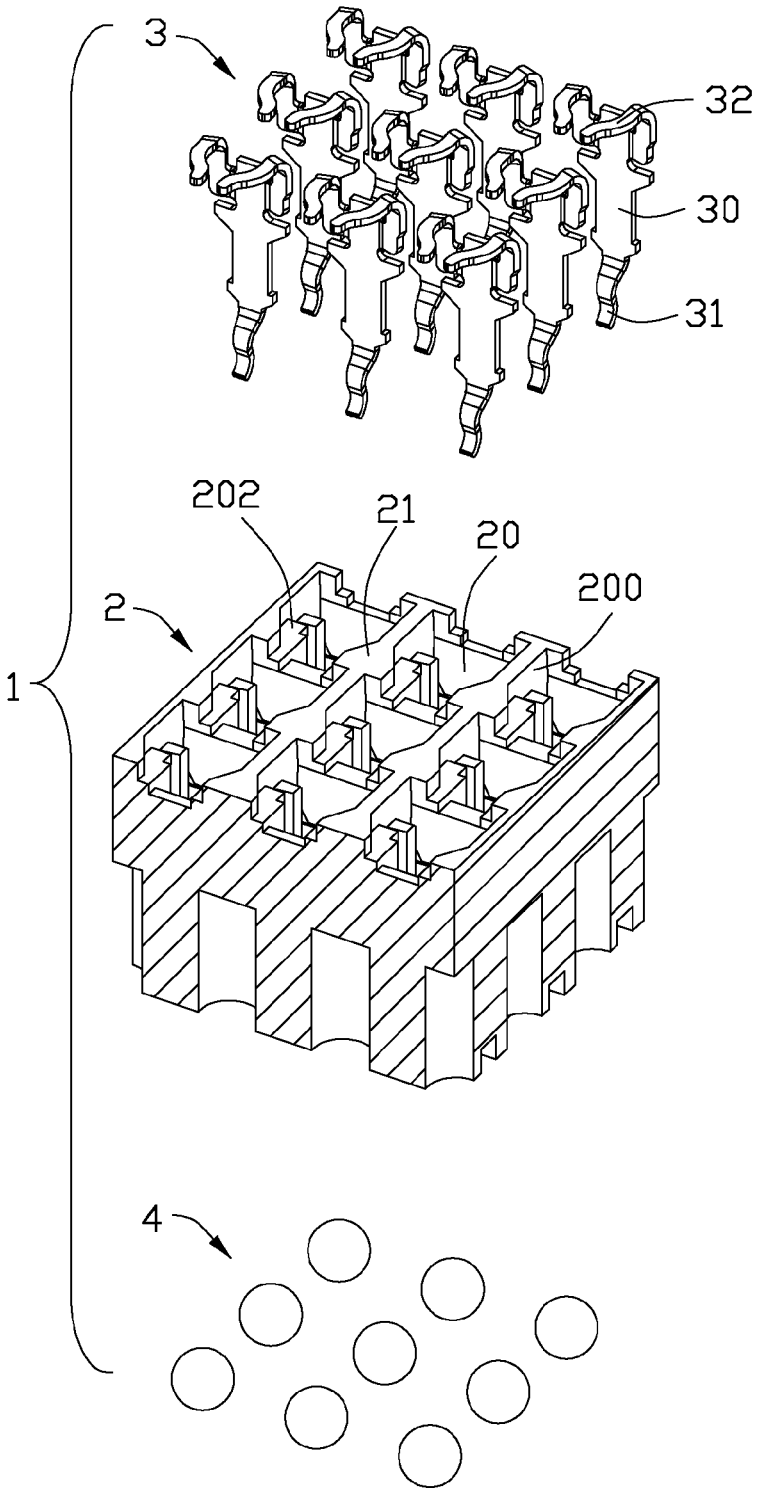
FIG. 3 is an exploded, perspective view of the electrical connector as shown in FIG. 1.

An electrical connector 1 according to the present invention is used to electrically connect a chip module (not shown) to a printed circuit board (not shown). Referring to FIGS. 1-3, the electrical connector 1 comprises an insulative housing 2 having a plurality of terminals 3 received therein and a plurality of solder balls 4 accommodated in the insulative housing 2. The insulative housing 2 has a top surface 21, a bottom surface 22 and a plurality of receiving holes 20 penetrated the top surface 21 and the bottom surface 22. The terminals 3 and the solder balls 4 are received in the receiving holes 20. The terminals 3 are assembled to the receiving holes 20 from the top surface 21 of the insulative housing 2 and the solder balls 4 are assembled to the receiving holes 20 from the bottom surface 22 of the insulative housing 2 in order to connect with the corresponding terminals 3.

Figure 4:
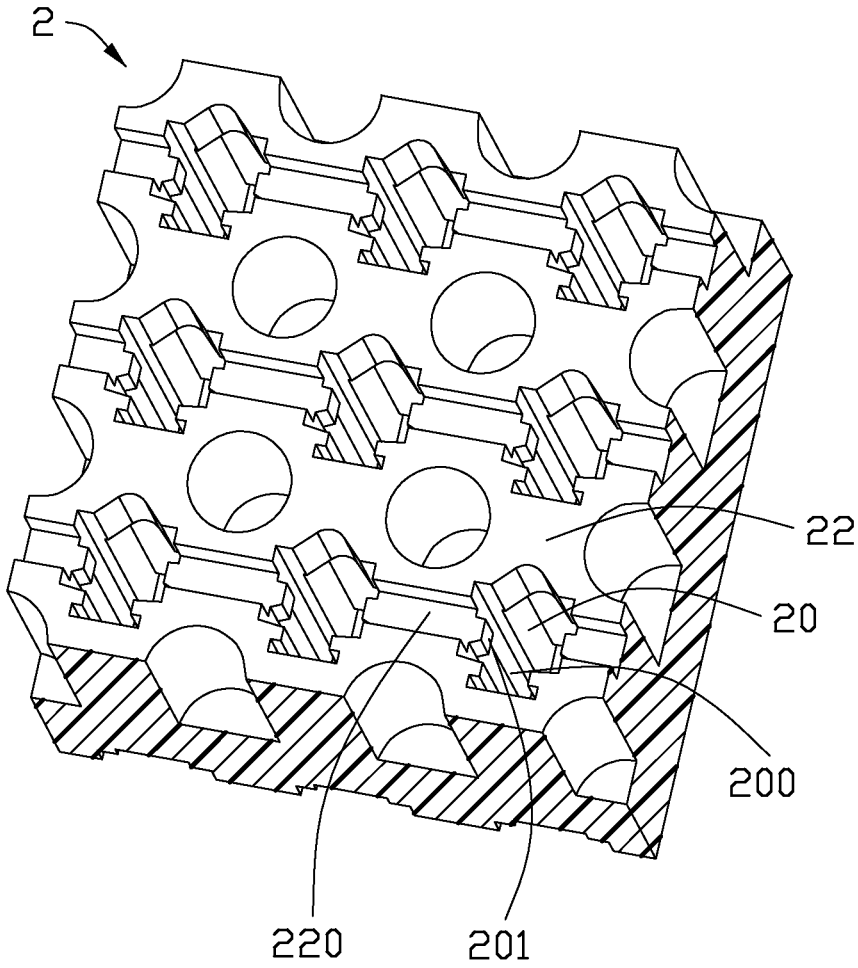
FIG. 4 is a perspective view of the insulative housing of the electrical connector as shown in FIG. 1.
Figure 5:
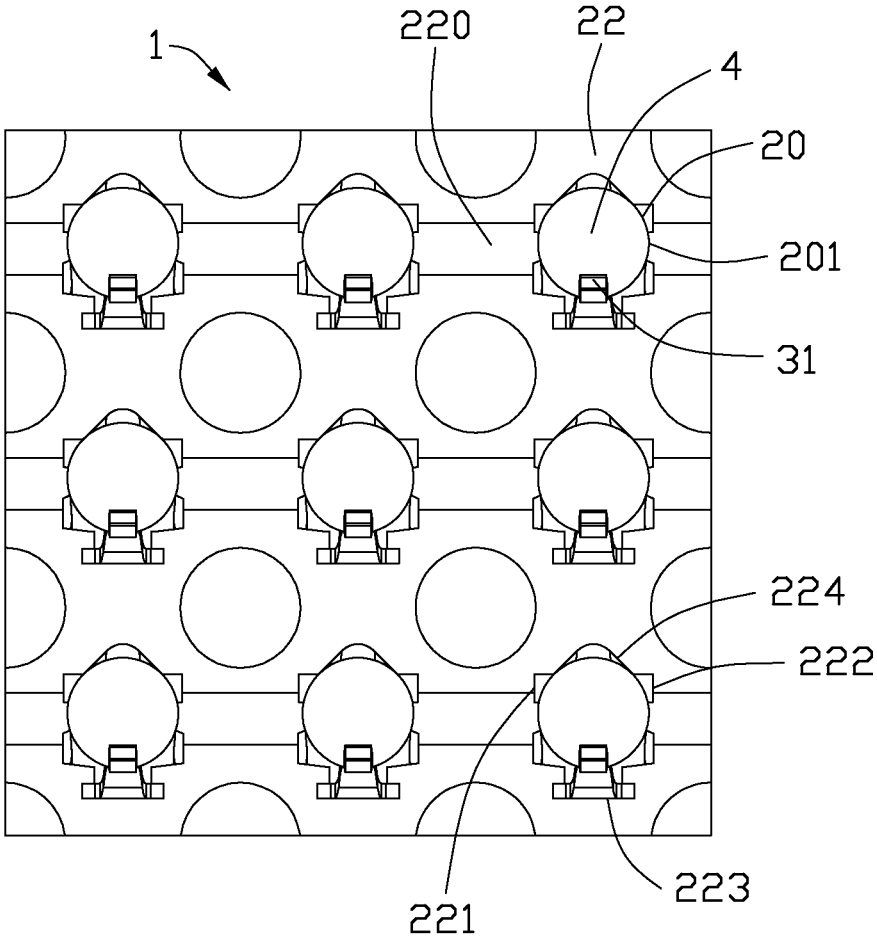
FIG. 5 is a bottom view of the electrical connector as shown in FIG. 1.
Figure 6:
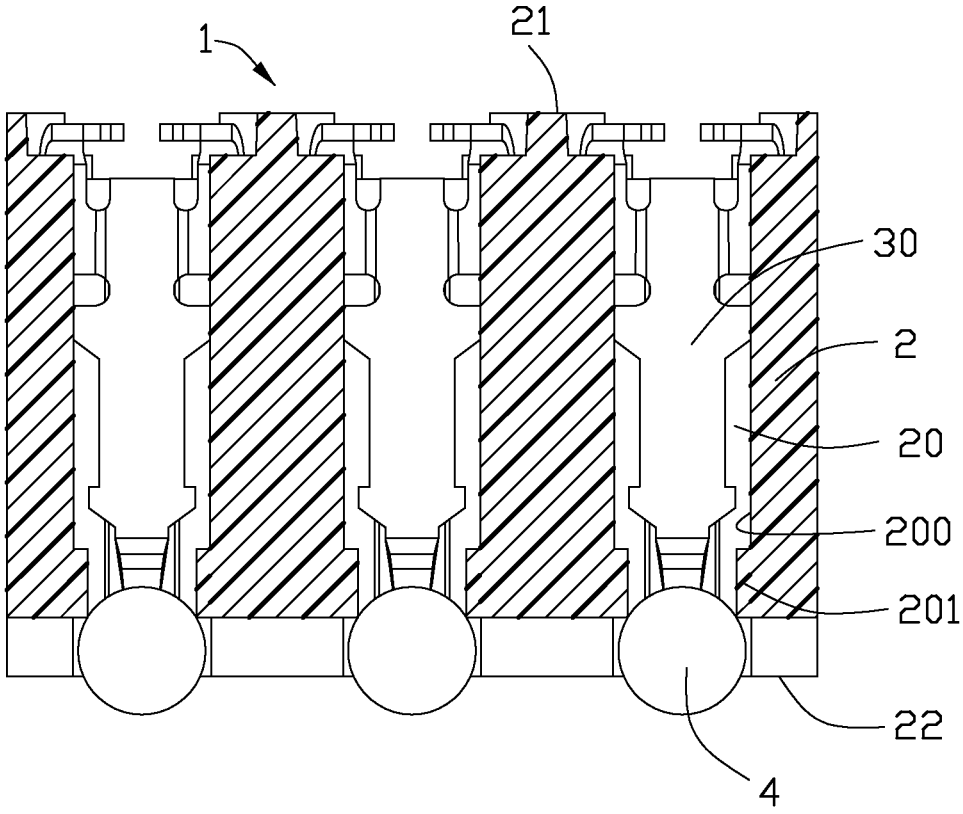
FIG. 6 is a cross-sectional view of the electrical connector as shown in FIG. 1.

Referring to FIGS. 4-6, the terminal 3 comprises a base 30, a soldering tail 31 extending downwardly from the base 30, a pair of contacting portions 32 extending upwardly from the base 30 and then bending transversely along with the horizontal direction and a pair of barbs (not labeled) extending from a two sides of the base 30. The pair of contacting portions 32 extending towards to each other and in contacting with the conductor (not shown) of the chip module.

The solder balls 4 are positioned in the insulative housing 2 by the soldering tail 31 together with the receiving holes 20. The receiving hole 20 has an inner wall 200 and a core (not labeled). The base 30 interferes with the inner wall 200 of the receiving hole 20 for positioning the terminal 3 therein. The inner wall 200 comprises a first sidewall 221 and a second sidewall 222 opposite to each other, a third sidewall 223 connected the first sidewall 221 and the second sidewall 222 and a fourth sidewall 224 opposite to the third sidewall 223. Each of the first sidewall 221 and the second sidewall 222 have a pair of ribs 201 extending toward each other and in an opposite direction. The rib 201 extends along the first sidewall 221 and the second sidewall 222 of the insulative housing 2. The movement of the solder ball 4 in a vertical direction is limited by the pair of ribs 201 and the pair of the ribs 201 can prevent the solder ball 4 falling into the insulative housing 2. The soldering tail 31 extends to the third sidewall 223 and contacts with the solder ball 4. The fourth sidewall 224 is configured to V-shape for compressing the solder ball 4 and the fourth sidewall perpendicular to the bottom surface 22.

The bottom surface 22 has a plurality of recesses 220 corresponding to the ribs 201. The recess 220 passes through the adjacent receiving holes 20 in horizontal, so the solder ball 4 is easy to be assembled to the receiving hole 20. The two sides of the solder balls 4 are received in the two sides of the recesses 220 partially. The recesses 220 can reduce the difficulty of manufacturing the insulative housing 2 and it can cut down the cost.

In addition, the insulative housing 2 has a plurality of supporting portion 202 depressing from the top surface 21 to the bottom surface 22. The top surface 21, the supporting portion 202 and the inner wall 200 forms a step and then the supporting portion 202 is step-shaped. The supporting portion 202 locates on the lower side of the contacting portion 32 and supports the contacting portion 32 when the contacting portion 32 is pressed downwardly, so it can prevent the contacting portion 32 from being pressed excessively and from being deformed when the terminals are assembled into the insuative housing because of a mistake or operation non-standardly.

When assembling the electrical connector 1, firstly, inserting the terminal 3 to the receiving hole 20, then pressing the solder ball 4 to the receiving hole 20 from the bottom surface 22 of the insulative housing 2 in suitable depth. The solder ball 4 is positioned by the soldering tail 31 and the fourth sidewall 224 with V-shaped at the same time. The movement of the solder ball 4 in a vertical direction is limited by the pair of ribs 201 and the solder ball 4 is clipped to the receiving hole 20 accurately by the V-shaped fourth sidewall 224 and compressed by the soldering tail 31 with three points. After assembly, the contacting portion 32 locates on the lower side of the top surface 21 of the insulative housing 2. In this embodiment, the soldering tail 31 provides forces against the solder ball 4 in both the vertical direction and the horizontal direction wherein the pair of diametrically arranged ribs 201 cooperates with the soldering tail 31 to restrict movement of the solder ball 4 in the vertical direction while the wedged or V-shaped structure on the fourth sidewall 224 cooperates with the soldering tail 31 to restrict movement of the solder ball 4 in the horizontal direction, thus essentially forming a five points positioning arrangement with regard to the solder ball 4, i.e. three points in the vertical direction and three points in the horizontal direction under condition of sharing one same point, i.e., the point formed by the soldering tail, for holding the solder ball 4 in the corresponding receiving hole 20.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing having a top surface, a bottom surface opposite to the top surface and a plurality of receiving holes penetrated the top surface and the bottom surface;

a plurality of terminals received in the receiving holes and having a soldering tail extending beyond the bottom surface; and a plurality of solder balls assembled to the receiving holes from a bottom surface thereof and contacting with the corresponding terminals;

wherein the receiving hole comprises an inner wall and a pair of ribs extending from the inner wall, the movement of the solder ball in a vertical direction is limited by the pair of ribs and the solder ball is positioned by the terminal together with the inner wall with three points;

wherein the bottom surface has a plurality of recesses connecting the adjacent receiving holes in a horizontal direction;

wherein the line that connected the center of the solder ball and the center of the recess is perpendicular to the line that connected the center of the solder ball and the center of the soldering tail.

2. The electrical connector as claimed in claim 1, wherein the pair of ribs extending toward each other and extending along a first sidewall and a second sidewall of the receiving hole, wherein the solder ball is limited by the pair of the ribs.

3. The electrical connector as claimed in claim 2, wherein the insulative housing has a plurality of recesses connecting the adjacent receiving holes in a horizontal direction.

4. The electrical connector as claimed in claim 2, wherein the receiving hole comprises a third sidewall connecting the first sidewall and the second sidewall respectively, wherein the terminal comprises a soldering tail extending toward the third sidewall and contacting with the solder ball.

5. The electrical connector as claimed in claim 4, wherein the receiving hole also comprises a fourth sidewall opposite to the third sidewall and the fourth sidewall is configured to V-shape for compressing the solder ball and perpendicular to the bottom surface.

6. The electrical connector as claimed in claim 1, wherein the terminal comprises a pair of contacting portions, the insulative housing comprises a supporting portion located on the lower side of the pair of contacting portions, wherein the supporting portions can prevent the contacting portion from being pressed excessively and from being deformed.

7. An electrical connector comprising:

an insulative housing having a top surface, a bottom surface opposite to the top surface and a plurality of receiving holes penetrated the top surface and the bottom surface;

a plurality of terminals received in the receiving holes; and a plurality of solder balls assembled to the receiving holes from a bottom surface thereof and contacting with the corresponding terminals;

wherein the receiving hole has an inner wall which comprises a first sidewall, a second sidewall opposite to the first sidewall, a third sidewall connecting the first sidewall and the second sidewall and a fourth sidewall opposite to the third sidewall;

wherein the terminal comprises a soldering tail extending toward the third sidewall and contacting with the solder ball; and wherein the solder ball is positioned by the terminal together with the fourth sidewall with three points.

8. The electrical connector as claimed in claim 7, wherein the fourth sidewall of the receiving hole is perpendicular to the bottom surface of the insulative housing.

9. The electrical connector as claimed in claim 7, wherein the receiving hole has a core and the inner wall comprises a pair of ribs extending toward the core, wherein the movement of the solder ball in a vertical direction is limited by the rib.

10. The electrical connector as claimed in claim 9, wherein the bottom surface has a plurality of recesses connecting the adjacent receiving holes in a horizontal direction.

11. The electrical connector as claimed in claim 9, wherein the inner wall has a pair of ribs extends toward each other and extends along a first sidewall and a second sidewall of the receiving hole, wherein the movement of the solder ball in a vertical direction is limited by the pair of the ribs.

12. The electrical connector as claimed in claim 11, wherein the insulative housing has a plurality of recesses connecting the adjacent receiving holes in a horizontal direction.

13. The electrical connector as claimed in claim 9, wherein the terminal comprises a pair of contacting portions and the insulative housing comprises a supporting portion located on the lower side of the pair of contacting portions, wherein the supporting portions can prevent the contacting portion from being pressed excessively and from being deformed.

14. The electrical connector as claimed in claim 7, wherein the fourth sidewall is configured to V-shape for positioning the solder ball.

15. An electrical connector comprising:

an insulative housing defining opposite upper and bottom surfaces plurality of receiving holes extending through both the upper and bottom surfaces;

a plurality of contacts disposed in the corresponding receiving holes, respectively, each of said contacts defining a contacting section extending above the upper surface and a soldering tail extending around the bottom surface;

a plurality of solder balls disposed in bottom portions of the corresponding receiving holes, respectively;

each of said solder balls being retained in the bottom portion of the corresponding receiving hole via five points; wherein in each of said contacts the soldering tail defines one of said five points to upwardly support the corresponding solder ball, and in each of the receiving holes, the housing provides a first pair of points cooperating with the point of the soldering tail of the corresponding contact to retain the solder ball in position in a vertical direction, and further provides a second pair of points cooperating with the point of the soldering tail of the corresponding contact to retain the solder ball in position in a horizontal direction perpendicular to said vertical direction.

16. The electrical connector as claimed in claim 15, wherein the first pair of points and the second pair of points are located different levels in the vertical direction.

17. The electrical connector as claimed in claim 16, wherein the second pair of points is closer to the bottom surface than the first pair of points is.

18. The electrical connector as claimed in claim 15, wherein the first pair of points are arranged diametrically.

19. The electrical connector as claimed in claim 15, wherein the second pair of points and the point of the soldering tail of the corresponding contact commonly form an acute angle isosceles triangle.

* * * * *